United States Patent [19]

Shoji

[11] Patent Number: 4,810,229

[45] Date of Patent: Mar. 7, 1989

[54] OMNIDIRECTIONAL TOY VEHICLE

[75] Inventor: Takashi Shoji, Tokyo, Japan

[73] Assignee: Kabushiki Kaisha Bandai, Tokyo, Japan

[21] Appl. No.: 97,104

[22] Filed: Sep. 16, 1987

[30] Foreign Application Priority Data

Dec. 16, 1986 [JP] Japan ..... 61-299366

[51] Int. Cl.[4] ..... A63H 29/00

[52] U.S. Cl. ..... 446/443; 446/460; 446/463; 446/469

[58] Field of Search ..... 446/460, 437, 436, 462, 446/443, 468, 463, 454, 456

[56] References Cited

U.S. PATENT DOCUMENTS 3,871,129 3/1975 Tong ..... 446/437

FOREIGN PATENT DOCUMENTS 570048 8/1958 Belgium ..... 446/460

*Primary Examiner*—Mickey Yu

*Attorney, Agent, or Firm*—R. Gale Rhodes, Jr.

[57] ABSTRACT

An omnidirectional toy vehicle has: a plurality of bearing members rotatively mounted on a chassis, each bearing member bearing an associated drive wheel and having a hollow portion at the center thereof along the whole length thereof; a steering mechanism including a stepping mechanism constructed of Geneva gears and a ratchet mechanism and being coupled to the bearing members in unison; and a drive mechanism including a power transmission mechanism for driving the drive wheels through the hollow portions of the plurality of bearing members. The outer, opposite sides of each wheel may be colored differently to indicate the direction of movement of the vehicle.

1 Claim, 4 Drawing Sheets

OMNIDIRECTIONAL TOY VEHICLE

BACKGROUND OF THE INVENTION 1. (Field of the Invention)

The present invention relates to an omnidirectional toy vehicle capable of being driven straight in a desired direction using a steering mechanism to which a plurality of bearing members are coupled in unison for causing all drive wheels to be directed to a same direction.

2. (Description of Related Art)

In a conventional toy vehicle, front wheels are mounted on a chassis of the vehicle such that a steering member coupled to the front wheels causes to direct the front wheels in any desired direction. On the other hands, the rear wheels are coupled to a bearing member fixedly connected to the chassis and they are powered from a drive mechanism such as a motor.

With the conventional construction as above, since the bearing member for the rear wheels is fixedly connected to the chassis, the toy vehicle turns to the left or right along a circular locus with only the front wheels directed to the turning side. Thus, it is impossible to drive the toy vehicle directly and straight to a desired direction.

SUMMARY OF THE INVENTION

The above prior art problems have been solved in accordance with the present invention which provides an omnidirectional toy vehicle comprising a plurality of bearing members rotatively mounted on a chassis, each bearing member bearing an associated drive wheel and having a hollow portion at the center thereof along the whole length thereof; a steering mechanism coupled to the bearing members in unison and including a stepping mechanism and the like, the stepping mechanism including Geneva gears and a ratched mechanism; a drive mechanism including a power transmission mechanism for driving the drive wheels through the hollow portions of the plurality of bearing members.

In operation of the above structure, since the plurality of bearing members of the drive wheels are coupled in unison, it is possible to allow the steering operation of all the drive wheels at a time relative to the chassis so that the toy vehicle can be directed straight in a desired direction. In addition, use of the steering mechanism including a stepping unit mounted on the bearing member allows an easy steering. Further, the hollow portion formed vertically along the length of the bearing member mounted on the chassis is used as a power transmission path of the drive mechanism, so that power can be freely transmitted to the wheels without interfering with the direction of a wheel at that time defined by the steering mechanism.

The invention will become apparent from the following detailed description when read in conjunction with the accompanying drawings, wherein.

DETAILED DESCRIPTION OF THE PREFERRED EMBODIMENT

Figure 1:
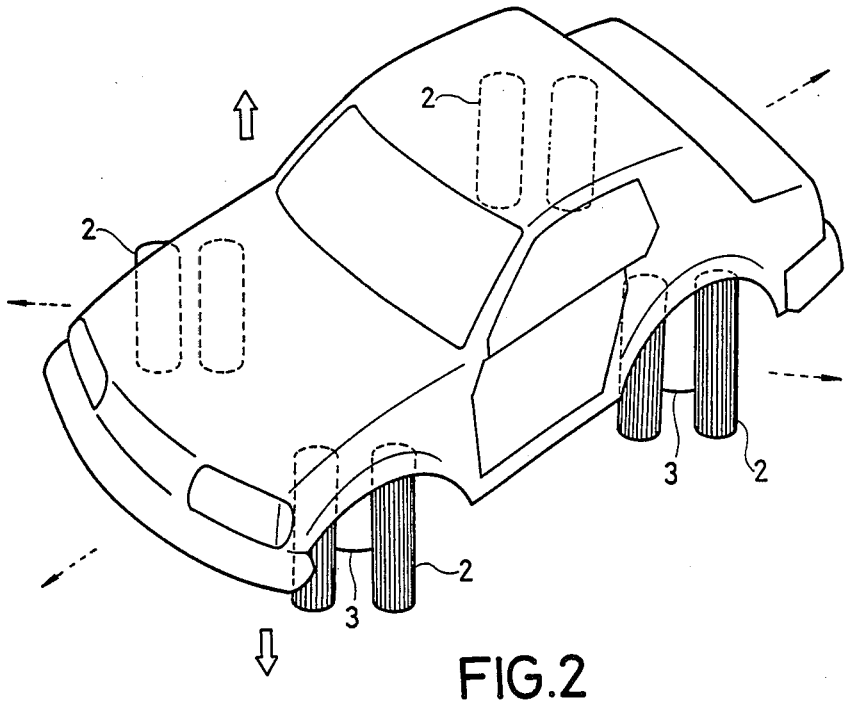
FIG. 1 is a perspective view of an embodiment of an omnidirectional toy vehicle according to the present invention.

A preferred embodiment of the present invention will be described with reference to the accompanying drawings. Reference numeral 1 represents a chassis of a toy vehicle having a plurality of drive wheels 2. A plurality of bearing members 3 are mounted rotatively on the chassis 1. Each bearing member 3 bears a corresponding drive wheel 2 at its shaft 20. The bearing member is formed with a hollow portion at the center thereof along the whole length thereof. A steering mechanism is constructed of the rotatable bearing members 3 and a stepping mechanism comprising Geneva gears and a ratchet mechanism.

Figure 2:
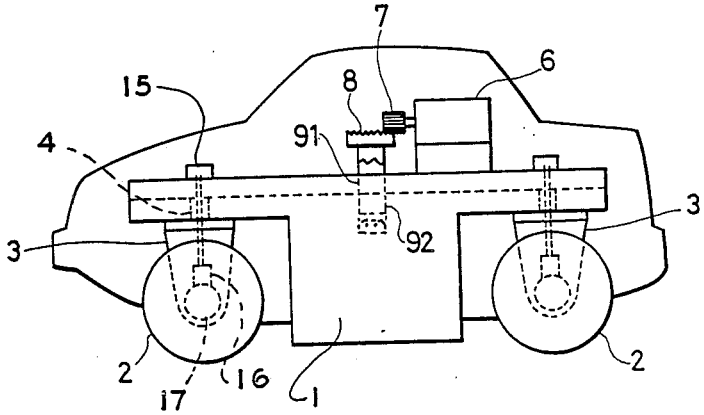
FIG. 2 is a side view, with the main part partially in cross section, of the omnidirectional toy vehicle according to the present invention.
Figure 5A:
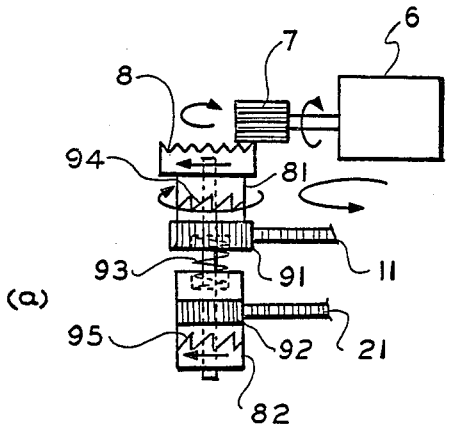
FIGS. 5(*a*) and (*b*) show an example of known clutch mechanisms.
Figure 5B:
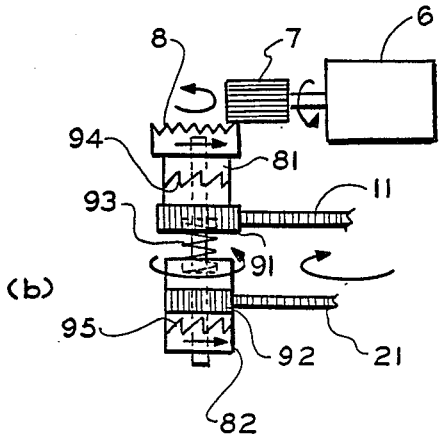

Referring to FIG. 2, a motor 6 is arranged to be rotated in the clockwise direction and in the counter-clockwise direction. The drive shaft of the motor 6 is provided with a pinion 7 which meshes with a crown gear 8. A clutch mechanism is provided below the crown gear 8. An example of clutch mechanisms well known in the art is shown in FIG. 5. A pair of clutch members 81 and 94 with opposing teeth is coupled to the shaft of the crown gear 8, and another pair of clutch members 95 and 82 with opposing teeth is coupled to the same shaft of the crown gear. The clutch members 94 and 95 have gears 91 and 92 respectively coupled thereto. A spring 93 is mounted on the crown gear shaft between the gears 91 and 92. Therefore, the gear 91 is rotated only when the crown gear 8 is rotated in the clockwise direction, while the gear 92 is rotated only when the crown gear is rotated in the counter-clockwise direction.

Figure 3:
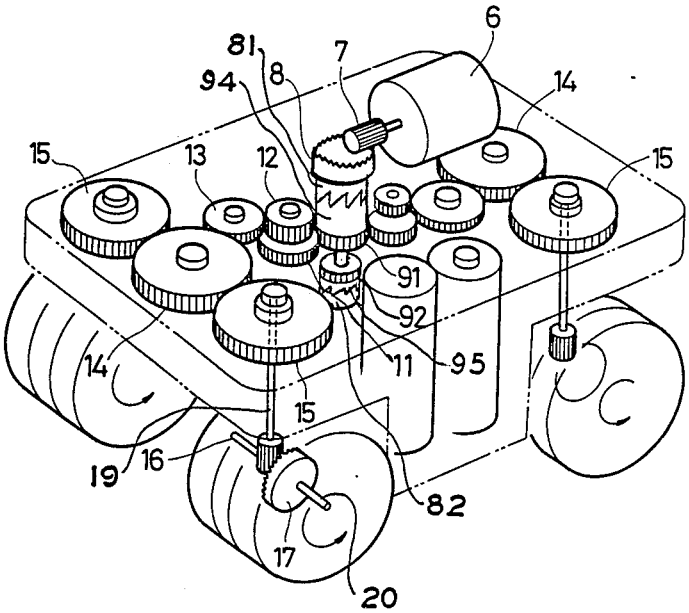
FIG. 3 is a perspective view of the main part of the drive mechanism for drive wheels.
Figure 4:
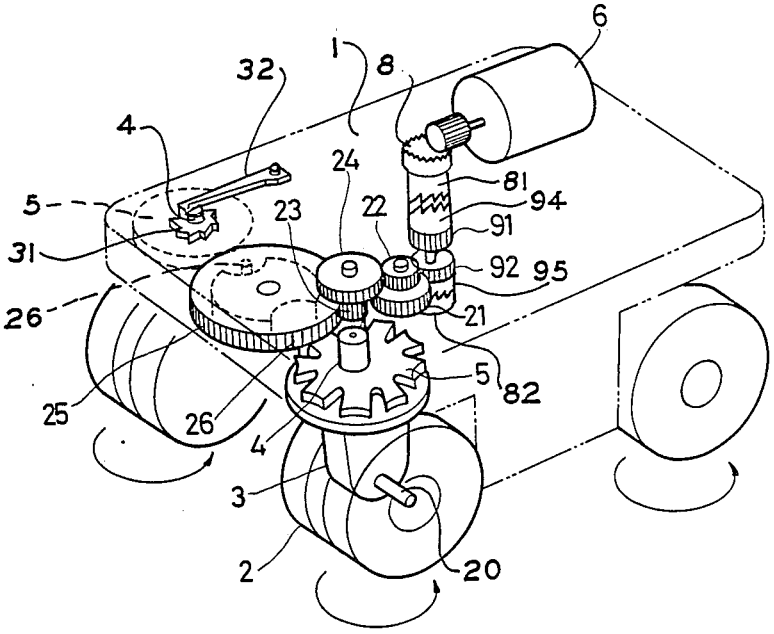
FIG. 4 is a perspective view of the main part of the steering mechanism for drive wheels.

Referring to FIG. 3, on the side of the gear 91, a speed reduction mechanism is mounted on both the front and rear of the chassis, the mechanism comprising a spur gear 11, a gear 13 meshing with a gear integrally mounted on the gear 11, a gear 14 meshing with the gear 13 and so on. A drive mechanism for driving the drive wheels 2 is constructed of a pinion 15 meshing with the spur gear 14 and mounted on a shaft 19 inserted into the hollow portion, a crown gear 16 meshing with a pinion 17 connected to the drive wheel shaft 20. The crown gear 16, pinion 17 are housed within the hollow portion of the bearing member 3.

On the other hand, on the side of the gear 92, another speed reduction mechanism is mounted on both the front and rear of the chassis, the mechanism comprising a spur gear 21, a gear 24 meshing with a gear 22 integrally mounted on the gear 23 and so on. Onetooth feeding pins 26 are provided on opposite lower peripheries of the spur gear 25 which engage with Geneva gears 5 to drive the steering mechanism for the drive wheels 2. On one of the Geneva gears 5, a ratchet mechanism comprising a latch gear 31 mounted on the Geneva gear 5 and a pawl 32, is provided which mechanism prevents the Geneva gear 5 from being moved while the gear 91 is driven by the clockwise rotation of the crown gear 8.

With the construction as above, as the motor 6 is rotated in the clockwise direction as shown in FIG. 5(*a*), the crown gear 8 meshing with the pinion 7 rotates in the clockwise direction. Therefore, the clutch mechanism coupled to the crown gear 8 causes the gear 91 to rotate. Each drive wheel 2 is driven by means of the speed reduction mechanism comprising the spur gear 11, gear 13, gear 14, and the like, and by means of the drive mechanism comprising the spur gear 15, pinion 16, crown gear 17 and the like. As a result, the drive wheels 2 are rotated to run the toy vehicle. In this case, the steering mechanism is maintained stopped at a previously set position due to the engagement of the latch gear 31, and the pawl 32 even if any torque is applied to the drive mechanism of the steering mechanism.

Next, as the motor 6 is rotated in the counter-clockwise direction as shown in FIG. 5(*b*), the crown gear 8 meshing with the pinion 7 rotates in the counter-clockwise direction. Therefore, the clutch mechanism coupled to the crown gear 8 causes the gear 92 to rotate. The one-tooth feeding pin 26 is rotated by means of the speed reduction mechanism constructed of the spur gear 21, gear 22, gear 23, pinion 24 and spur gear 25 so that the Geneva gear engaging with the spur gear 25 is advanced by one tooth after another to at the same time change the direction of all the bearing members. Thereafter, when the motor 6 is again rotated in the clockwise direction, the toy vehicle is caused to run in the direction as determined by the drive wheels 2. In this concern, outer opposite sides of each drive wheel 2, e.g., at hub portions or tire sidewalls, may be colored different, such as one with red colored and the other with blue colored. Thus, the player can easily recognize the forward or backward direction in which the toy vehicle is then caused to move.

As described so far, the omnidirectional toy vehicle with drive wheels according to the present invention comprises the steering mechanism including the stepping mechanism constructed of Geneva gears and a ratchet mechanism and the like, and the drive mechanism for driving the drive wheels through the hollow portion of the bearing members. Therefore, all the drive wheels can be directed in a same direction at a time. Thus, the toy vehicle is caused to run straight in the direction as determined by the steering members, without following the curved locus as in the case of a conventional toy vehicle. For example, the toy vehicle can be driven in zigzag fashion like a crab, or in an forward or backward oblique manner. Particularly, the toy vehicle can be driven easily in a small space such as a garage.

I claim:

1. An omnidirectional toy vehicle comprising:

a plurality of bearing members rotatively mounted on a chassis, each bearing member bearing an associated drive wheel mounted on a shaft and having a hollow portion at the center thereof along the entire length;

a steering mechanism constructed of said plurality of bearing members and a stepping mechanism, said stepping mechanism comprising Geneva gears fixedly mounted on said bearing members, and each of said Geneva gears being engaged with a first gear train;

a wheel drive mechanism for rotating a respective drive one of the wheels, each said wheel drive mechanism being coupled to a respective shaft of a respective drive wheel at within said hollow portion and being extended outside of said hollow portion whereat a second gear train is engaged thereto; and a clutch mechanism for engaging the drive shaft of a motor with said first gear train when said drive shaft is rotated in one direction, and with said second gear train when said drive shaft is rotated in the direction opposite to said one direction.

* * * * *